US011950660B2

(12) United States Patent
Bevin et al.

(10) Patent No.: US 11,950,660 B2
(45) Date of Patent: Apr. 9, 2024

(54) FOOTWEAR CLEATS DEVICE

(71) Applicants: Rebekah Bevin, Claremont, NH (US); Mathew Cardinali, Portland, ME (US)

(72) Inventors: Rebekah Bevin, Claremont, NH (US); Mathew Cardinali, Portland, ME (US)

(73) Assignee: Rebekah Bevin, Claremont, NH (US)

( * ) Notice: Subject to any disclaimer, the term of this patent is extended or adjusted under 35 U.S.C. 154(b) by 0 days.

(21) Appl. No.: 17/933,241

(22) Filed: Sep. 19, 2022

(65) Prior Publication Data

US 2023/0090546 A1 Mar. 23, 2023

Related U.S. Application Data

(60) Provisional application No. 63/246,361, filed on Sep. 21, 2021.

(51) Int. Cl.
*A43C 15/02* (2006.01)
*A43C 15/06* (2006.01)

(52) U.S. Cl.
CPC ..... *A43C 15/02* (2013.01); *A43C 15/063* (2013.01)

(58) Field of Classification Search
CPC ..... A43C 15/02; A43C 15/08; A43C 15/063
See application file for complete search history.

(56) References Cited

U.S. PATENT DOCUMENTS

| | | | | |
|---|---|---|---|---|
| 2,366,649 | A | 1/1945 | Priess | |
| 6,675,504 | B1 | 1/2004 | Biancucci | |
| 2005/0102864 | A1* | 5/2005 | Levy | A43C 15/02 36/132 |

FOREIGN PATENT DOCUMENTS

| | | |
|---|---|---|
| KR | 100657627 | 11/2005 |
| KR | 100823683 | 4/2008 |
| KR | 200441904 | 9/2008 |
| KR | 100917104 | 9/2009 |
| KR | 20110001989 | 2/2011 |
| KR | 20110019770 | 2/2011 |
| KR | 20140000781 | 2/2014 |

OTHER PUBLICATIONS

KR 200441904-Y1, published Sep. 17, 2008, with English translation (Year: 2008).*
KR-20140000781-U, published Feb. 5, 2014, with English translation (Year: 2014).*
KR-100917104-B1, published Sep. 15, 2009, with English translation (Year: 2009).*

(Continued)

*Primary Examiner* — Ted Kavanaugh
(74) *Attorney, Agent, or Firm* — Sheehan Phinney Bass & Green PA

(57) ABSTRACT

A fall prevention footwear accessory device includes a first strap configured to wrap around an upper portion and sole of the footwear at a ball portion of the footwear. A first fastener removably secures a looped first end of the first strap. A second fastener slidably receives the looped first strap and secures a second end of the first strap. A second strap includes a central cleat region that rotatably attaches to the second fastener post and removably attaches to a third fastener attached to the first strap. The device facilitates relocation of the second strap cleat region between a first position under the footwear sole and a second position over the footwear upper.

15 Claims, 11 Drawing Sheets

(56) References Cited

OTHER PUBLICATIONS

Construction Gear.com; "K1 Mid-Sole Ice Cleat"; https://www.constructiongear.com/k1mid-ice-cleats.html; Jun. 28, 2021.
Intercity Industrial Northern Safety; "Rip's Ice Cleats Sharp"; https://www.northernsafety.ca/products/rips-ice-cleats-sharp; Jun. 28, 2021.
Aliexpress; "5 Studs Ice Spikes for Shoes Ice Floes Cleats Crampons Winter Outdoor Snow Climbing Antislip Grips for Shoes Covers Crampons"; https://www.aliexpress.us/item/2251832828392873.html?gatewayAdapt=glo2usa4itemAdapt&_randl_shipto=US; Jun. 28, 2021.

* cited by examiner (Top View)

(Side View)

FOOTWEAR CLEATS DEVICE

CROSS-REFERENCE TO RELATED APPLICATIONS

This application claims the benefit of U.S. Provisional Patent Application Ser. No. 63/246,361, filed Sep. 21, 2021, entitled "Footwear Cleats Device," which is incorporated by reference herein in its entirety.

FIELD OF THE INVENTION

The present invention relates to footwear, and more particularly, is related to an anti-slip device.

BACKGROUND OF THE INVENTION

Use of wearable traction cleats is currently limited by users' ability to quickly, easily, and safely don and doff the cleats when transitioning from outdoors to indoors environments and vice versa. Specifically, traditional traction cleats, made of metal or hard plastics, are designed to be worn outdoors to provide stability and traction in icy and slick conditions, whereby making an unsafe situation when the user walks back indoors on to smooth floors and non pervious surfaces creating a slip-and-fall risk.

Unfortunately, doffing and donning traction cleats, for many users, is cumbersome, time consuming and difficult due to many physical barriers including but not limited to strength and motor skills, balance issues, vision loss and physical range of motion.

Many existing removable cleats involve the user having to remove an entire piece of molded footwear from their shoe in order to disengage the cleats which are embedded in, or attached to, the footwear device. This may be dangerous and create a user fall risk. For example, to transition from walking outside on an icy surface to walking inside a building, the user would typically either sit down, or bend over and balance on one leg, while trying to pull off the footwear from their shoe. Many types of one piece footwear devices are tight fitting in order to provide stability on the shoe, making it even more challenging to remove cleats from the shoe. It may not only be difficult and dangerous to remove cleats, it may also be dangerous to ambulate on slick, nonporous floors with the cleats engaged.

In implementations where cleats are attached to a band of elastic webbing, manipulation of the cleats may be challenging due to the tension of the elastic webbing around the shoe. In addition, the cleats may be too aggressive to be used on most sidewalks, creating a painful, dangerous, and off-balance gait pattern when ambulating. Therefore, there is a need in the industry to address the aforementioned deficiencies.

SUMMARY OF THE INVENTION

Embodiments of the present invention provide a footwear cleats device. Briefly described, the present invention is directed to a slip-and-fall prevention footwear accessory device having a first strap configured to wrap around an upper portion and sole of the footwear at a ball portion of the footwear. A first fastener removably secures a looped first end of the first strap. A second fastener slidably receives the looped first strap and secures a second end of the first strap. A second strap includes a central cleat region that rotatably attaches to the second fastener post and removably attaches to a third fastener attached to the first strap. The device facilitates relocation of the second strap cleat region between a first position under the footwear sole and a second position over the footwear upper.

Other systems, methods and features of the present invention will be or become apparent to one having ordinary skill in the art upon examining the following drawings and detailed description. It is intended that all such additional systems, methods, and features be included in this description, be within the scope of the present invention and protected by the accompanying claims.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principals of the invention.

DETAILED DESCRIPTION

Figure 1:
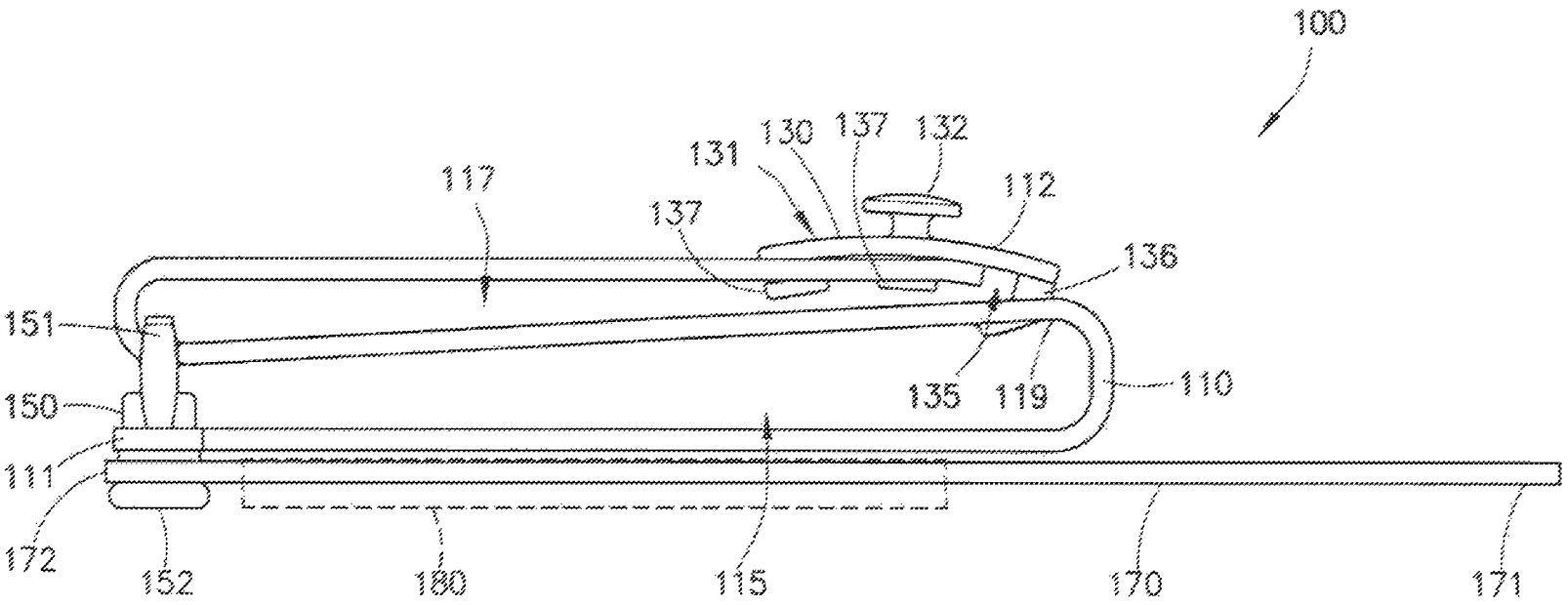
FIG. 1 is a schematic diagram showing a lateral view of a first exemplary embodiment of a footwear cleats device.

The following definitions are useful for interpreting terms applied to features of the embodiments disclosed herein, and are meant only to define elements within the disclosure.

As used within this disclosure, "substantially," means "very nearly," or "within typical manufacturing tolerances." In some instances, for example, when referring to shapes, "substantially" indicates the overall shape, for example, a substantially rectangular slot or shaft may have a longer length than width, but have rounded ends or edges. A substantially flat/planar surface may include a slight curve or contour.

As used within this disclosure, "footwear" refers to a shoe or boot worn by a person. The "ball portion" of the footwear refers to a cross section of the footwear corresponding to midfoot and/or forefoot of the wearer.

Reference will now be made in detail to embodiments of the present invention, examples of which are illustrated in the accompanying drawings. Wherever possible, the same reference numbers are used in the drawings and the description to refer to the same or like parts.

Exemplary embodiments of the device of the present invention are drawn to a footwear cleats device attachable to footwear, for example, a shoe or a boot. The device is generally attached to the footwear being wrapped around a forward portion of the footwear corresponding roughly to a ball of the foot of the wearer, with a bottom portion passing under the sole of the footwear, and a top portion wrapped around the top of the footwear, for example, over a laces portion. A relocatable cleat region may be attached to the device in a first (usage) position, where one or more cleats of the cleat region are under the sole of the footwear and protruding outward from the sole, and a second (storage) position, where the cleats are fastened over the top portion of the footwear ("footwear upper").

FIG. 1 is a lateral view of a first exemplary embodiment of a footwear cleats device 100. Under the first embodiment, the footwear cleats device 100 contains five major components: a shoe strap 110, for example, made of hypalon; a fastener 130, for example, made of glass filled nylon; a swivel piece 150, for example, made of glass filled nylon; a cleat strap 170, for example, made of hypalon; and a cleat region 180, for example made of rubber and steel cleats. It should be noted that while the first embodiment depicts five components, in alternative embodiments there may be two, three, four, six, or more components. The shoe strap 110 includes a shoe strap swivel end 111 and a shoe strap fastener end 112 at an opposite end of the shoe strap 110. The shoe strap swivel end 111 non-removably attaches to a swivel piece pin 152. For example, the swivel piece pin 152 may pass through an opening of the shoe strap 110 at the shoe strap swivel end 111. The shoe strap 110 attaches at the shoe strap fastener end 112 to a fastener bottom side 135, for example, via a pair of fit loop pins 137. The shoe strap 110 removably attaches to the fastener bottom side 135 on a shoe loop pin 136 at a shoe strap intermediate point 119 of the shoe strap 110 between the shoe strap swivel end 111 and the shoe strap fastener end 112.

From the shoe strap swivel end 111, the shoe strap 110 passes through an aperture of a swivel piece loop 151 portion of the swivel piece 150, forming a shoe strap shoe loop 115 that wraps around a front portion of a shoe. The shoe strap 110 continues on to the terminus at the shoe strap fastener end 112 forming a shoe strap fit loop 117. The shoe strap fit loop 117 is formed by a portion of the shoe strap 110 that partially overlaps the shoe strap shoe loop 115. The shoe strap fit loop 117 is used to adjust the tension of the shoe strap 110 around the shoe, for example, by inserting the shoe loop pin 136 through a selected one of a plurality of shoe loop pin holes (not shown) in the shoe strap 110 according to a desired size of the shoe strap shoe loop 115.

The cleat strap 170 rotatably attaches to the swivel piece pin 152 at a cleat strap swivel end 172. At the other end, the cleat strap 170 removably attaches to a cleat strap pin 132 located on the fastener 130 on a fastener top side 131 at a cleat strap fastener end 171. For example, the swivel piece pin 152 may be inserted through an aperture at the cleat strap swivel end 172 of the cleat strap 170 such that the cleat strap swivel end 172 is secured to the swivel piece pin, yet the cleat strap 170 may rotate freely around the swivel piece pin 152. The cleat strap 170 attaches to the fastener 130 in two configurations: A first configuration where the cleat region 180 is adjacent to the sole of the shoe and cleats project outward from the sole; the second configuration where the cleat strap 170 is rotated around the swivel piece pin 152 and spans across the top of the shoe, so the cleat region 180 extends across a top of a shoe, rather than across the sole.

Figure 2:
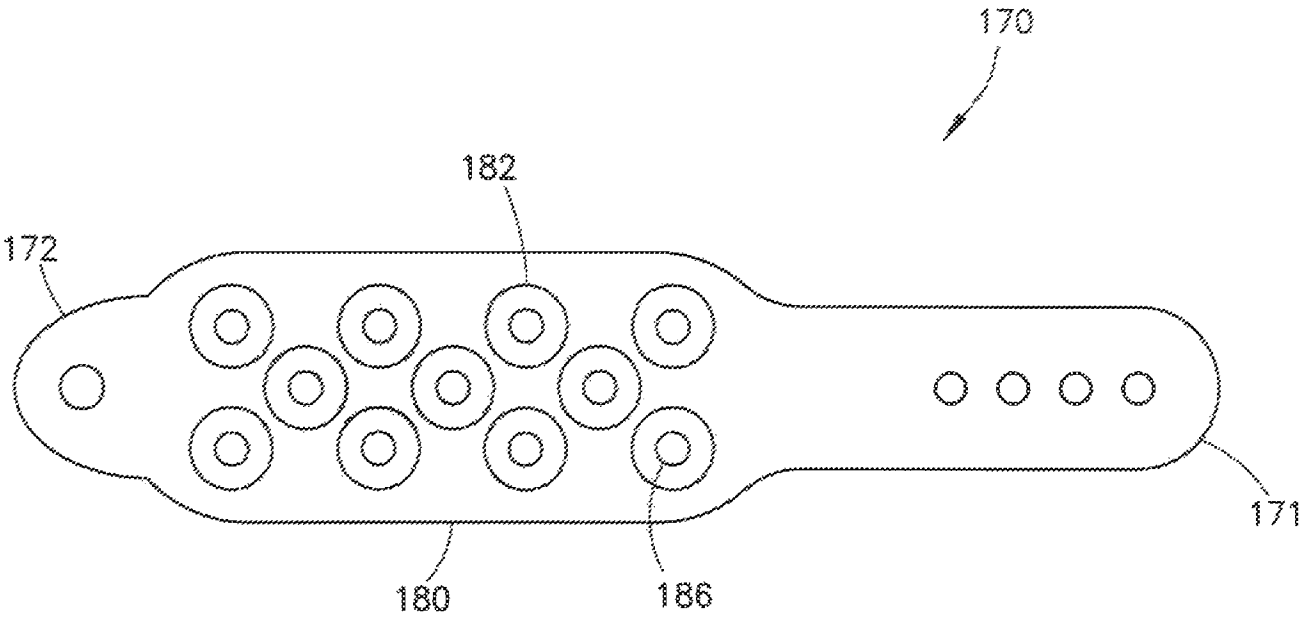
FIG. 2 is a schematic diagram illustrating cleat strap under the first exemplary embodiment of FIG. 1.

FIG. 2 is a schematic diagram illustrating a detailed view of the cleat strap 170 under the first exemplary embodiment. The cleat region 180 may be integral with the cleat strap 170. Both the cleat region 180 and the cleat strap 170 may be integrally formed of the same piece of material, for example, hypalon material. Examples of other types of material that may be used for the cleat region 180 and the cleat strap 170 include, but are not limited to, silicone rubber, thermoplastic rubber, thermoplastic elastomer, PVC, or nylon, among others. Hypalon is a synthetic rubber that is unaffected by extreme temperatures, resists abrasions, does not get brittle with exposure and resists chemicals. Hypalon also has stretch properties. Holes are punched in to the hypalon material of the shoe strap 110 and the cleat strap fastener end 171 to allow for an individualized fit, for example, like a watch strap. The hypalon material may be preferable to other materials, for example, because hypalon may be cut to length and the ends will not fray, compared with strapping made of other materials, for example, nylon materials. The shoe strap 110 may be formed of the same material as the cleat strap 170.

A plurality of cleats 182 are affixed to the cleat region 180. While FIG. 2 shows eleven cleats 182, the number of cleats 182 may be different according to various factors, for example, the size of the cleat region 180, the size of the cleat 182, and the particular application for the cleat strap 170 (for example, snow, ice, mud, among others), While FIG. 2 shows uniformly sized cleats 182, in alternative embodiments there may more than one type of cleats 182 in the cleat region 180. For example, there may be an outer ring of a first type of cleats 182 having a wider contact region to provide stability, where the outer ring surrounds an inner region with a second type of cleats 182 having a narrower contact region (sharper cleat) to better grip the walking surface. The cleats 182 may be "off the shelf," for example, as supplied by the manufacturer EONPOW Ice Grips steel studs (see www.amazon.com/gp/product/B018UDZT1I/ref=ppx_yo_dt_b_asin_title_o01_s00?ie=UTF8&p sc=1) and are made of a plastic pop-in cleats surrounding an alloyed steel material pin.

The cleats 182 may be positioned laterally from left to right in three rows substantially parallel to the length of the cleat region 180. Under the first embodiment, the top row has 4 cleats 182, the middle row has three cleats 182 and the bottom row has four cleats 182. The cleats are arranged to allow near to equal distribution across the cleat region 180 surface forming a grid like pattern. Different embodiments may have different arrangements of cleats 182 in the cleat region 180.

Figure 5:
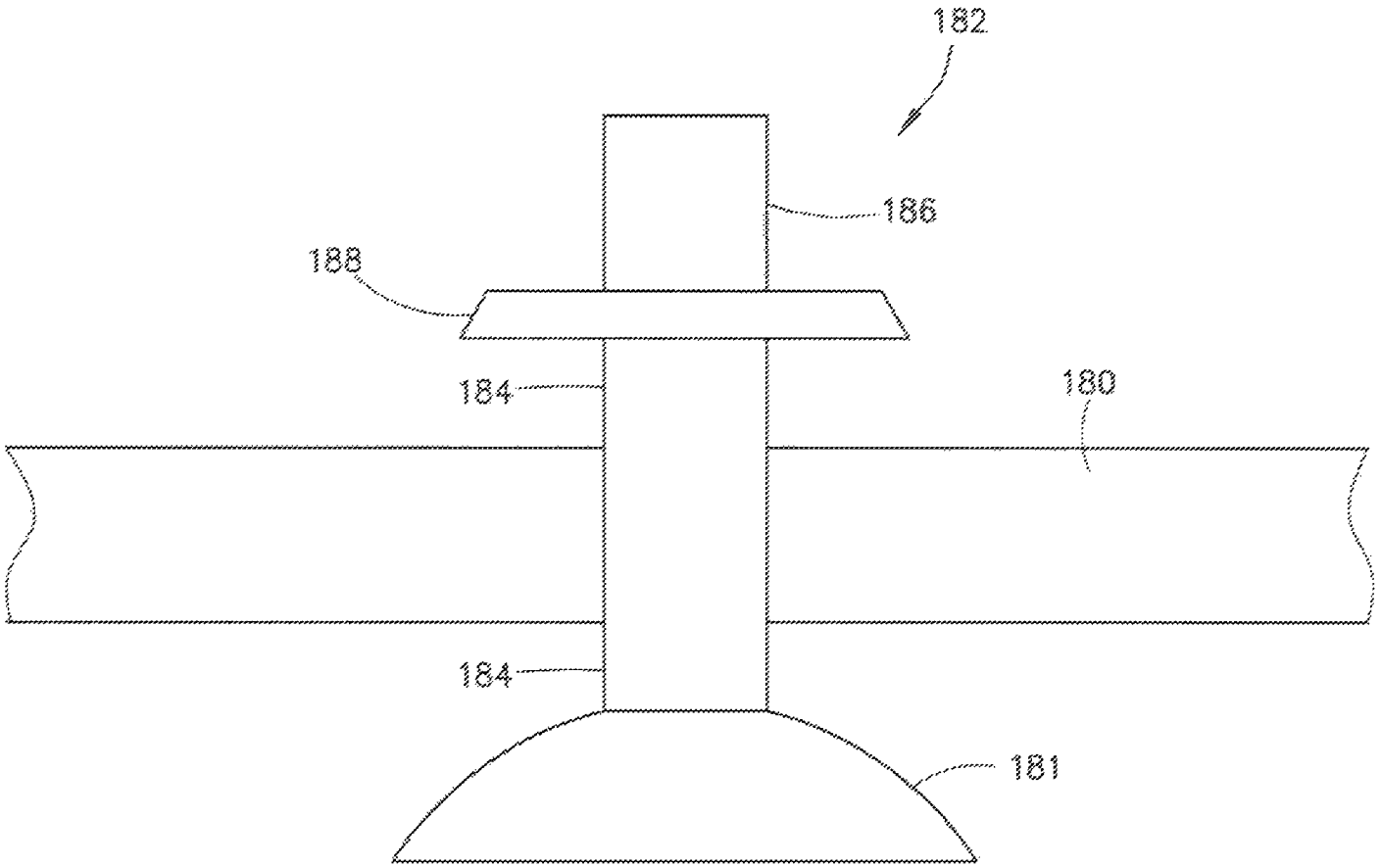
FIG. 5 is a schematic diagram illustrating a detail side view of the cleat region of FIG. 2 the cleats 182 attached to the cleat region 180.

As shown by FIG. 5, the cleats 182 may be affixed to the cleat region 180 by a cleat pin 184 punching through the cleat region 180. The cleat region 180 may be located between a cleat base 181 and a cleat washer 188. The cleat washer 188 may surround the cleat pin 184 and a protruding cleat pin tip 186.

Cleats 182 may be made out of other materials and have various lengths, weights, and durability, for example, including titanium or stainless steel. While the cleat strap 170 generally remains rotatably affixed to the swivel piece pin during operation, the cleat strap 170 may be removable from the swivel piece 150 at the swivel piece pin 152 to allow an interchange of the entire cleat strap 170 with cleats 182 having different lengths, configurations, and cleat materials for different types of terrain or weather conditions. The entire cleat region 180 may be replaced by swapping out the cleat strap 170. Alternatively, or in addition, the cleats 182 themselves may be individually interchanged, for example, by cleats 182 may pop-in/pop out of the cleat region 180.

The cleat strap 170 and cleat region 180 may be cast molded to allow the cleats 182 and the cleat region 180 to be integrally formed and the cleat base 181 encased in the material with only the cleat pin tip 186 protruding outward from the surface of the cleat region 180.

Figure 3:
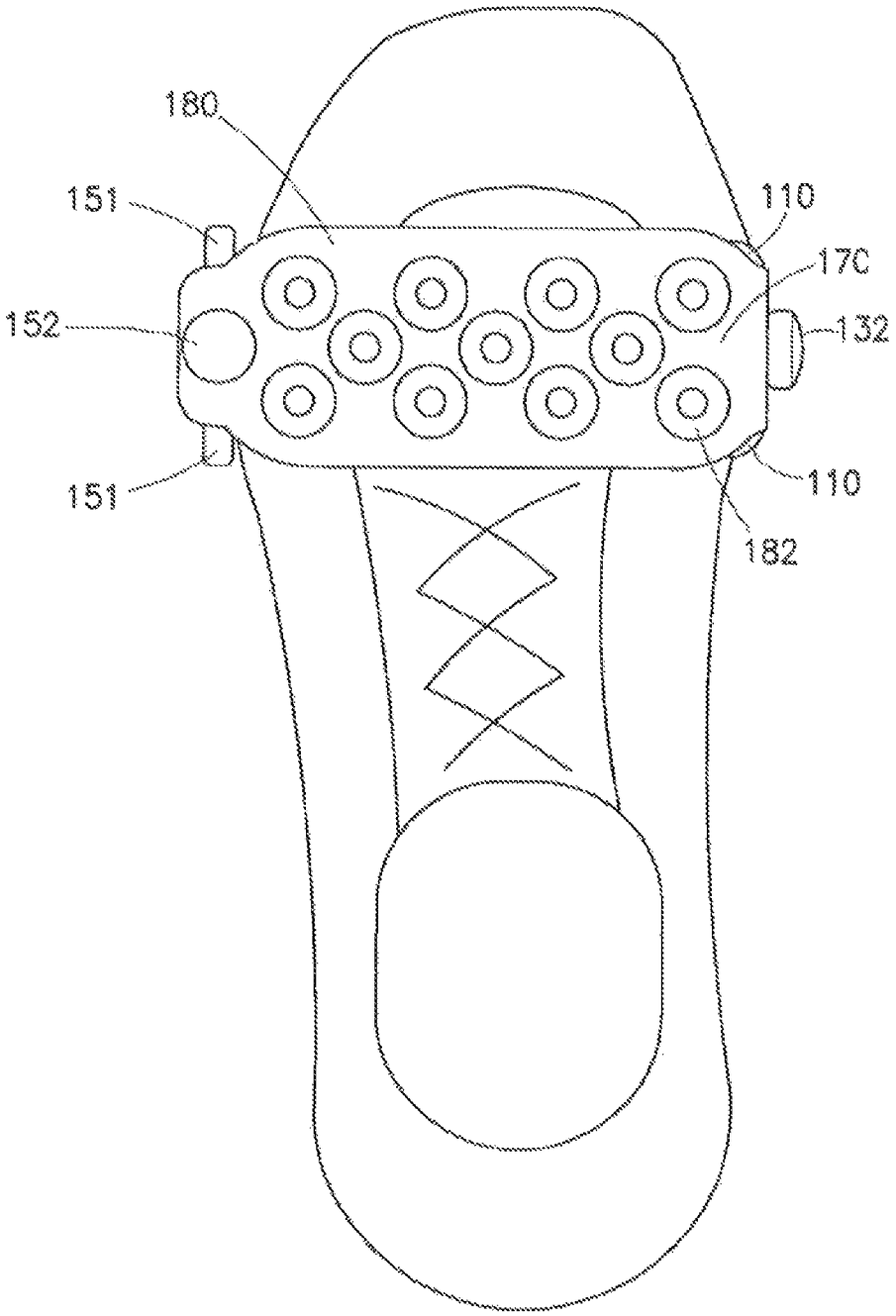
FIG. 3 is a schematic diagram of the footwear cleats device of FIG. 1 with the cleat region rotated to a storage position.
Figure 4:
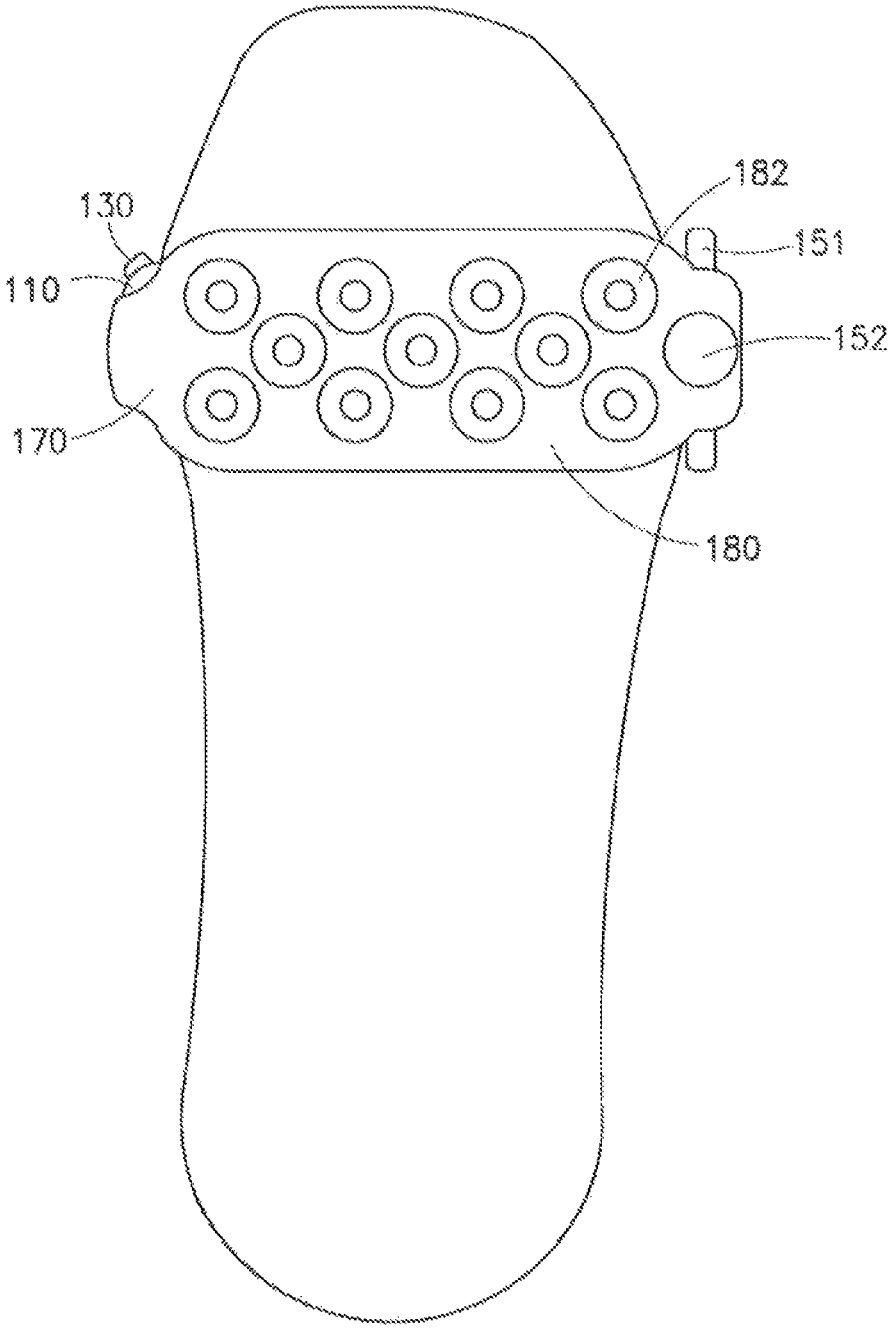
FIG. 4 is a schematic diagram of the footwear cleats device of FIG. 1 with the cleat region rotated to a use position.

The footwear cleats device 100 is intended to remain fixed on the shoe inside the shoe strap shoe loop 115, whether the cleat strap 170 is positioned across the top of the shoe as in FIG. 3 or across the sole of the shoe as in FIG. 4. The fastener 130 makes it efficient to position the cleat strap 170 in both an under-shoe (use) position (FIG. 4) and an over-shoe (storage) position (FIG. 3) without significantly contributing to bulk and weight of the footwear, which is desirable as it requires less user strength and manipulation skills. Advantageously, the fastener 130 provides three functions. The fastener 130 secures the footwear spikes device 100 on the shoe using the shoe loop pin 136 and the fit loop pins 137 and to secure the cleat strap 170 in both (use and storage) positions at the cleat strap pin 132.

The footwear cleats device 100 may be implemented in both child and adult sizes to accommodate various sizes for the cleat region 180. For example, the cleat region 180 may have a thickness in the range of 0.1 inch to 0.3 inches, a width in the range of 0.5 inches to 2.0 inches, and a length in the range of 3.0 inches to 7.0 inches, as appropriate to fit the specific shoe of the wearer, which may range from child sizes to adult sizes.

Figure 6:
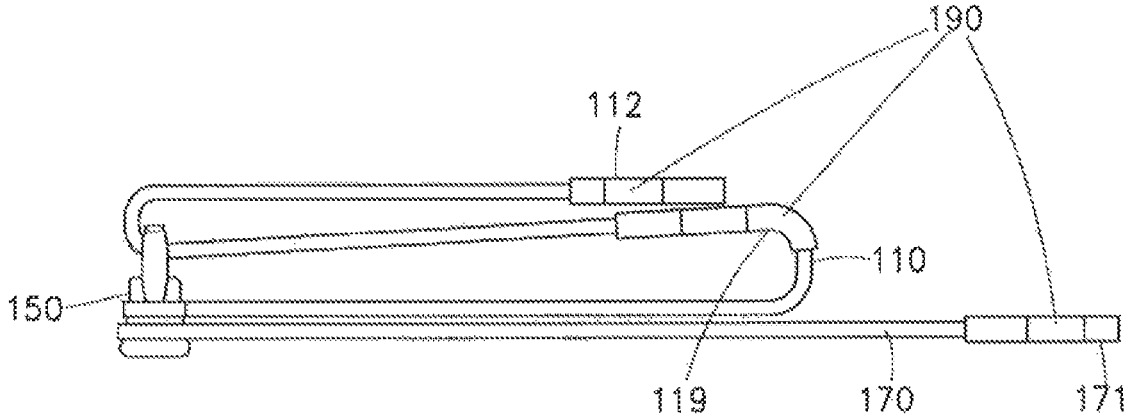
FIG. 6 is a schematic diagram of an alternative embodiment of a footwear cleats device with magnetic strap fasteners.
Figure 7:
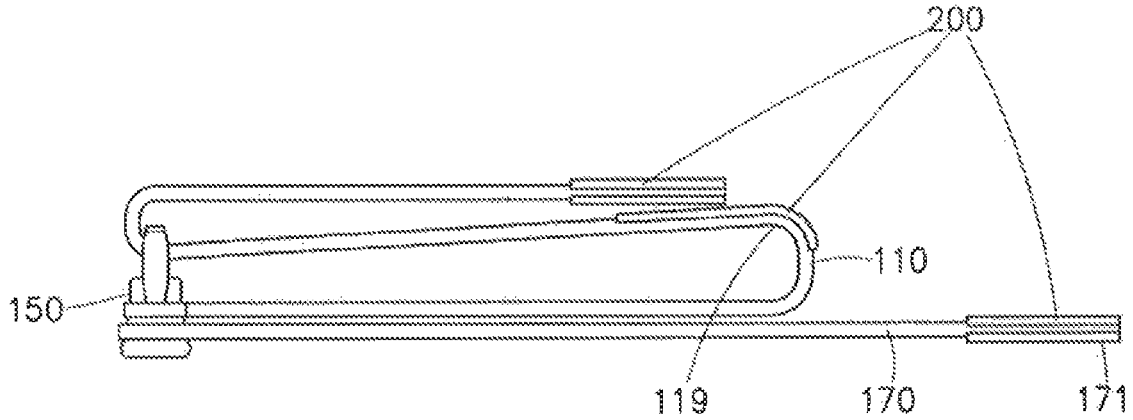
FIG. 7 is a schematic diagram of an alternative embodiment of a footwear cleats device with hook-and-loop strap fasteners.

In alternative embodiments, the fastener 130 may be implemented differently using other types of fasteners. FIG. 6 shows magnetic fasteners 190 and FIG. 7 shows hook-and-loop fasteners 200. For example, hook-and loop fasteners 200 may be convenient if molded into the shoe strap 110 and cleat strap 170 or otherwise attached to the shoe strap 110 and the cleat strap 170. It should be noted, however, the magnets 190 and the hook-and-loop fasteners 200 may not attach securely when exposed to excessive dirt, snow, ice, mud, and debris commonly found underfoot.

Figure 8:
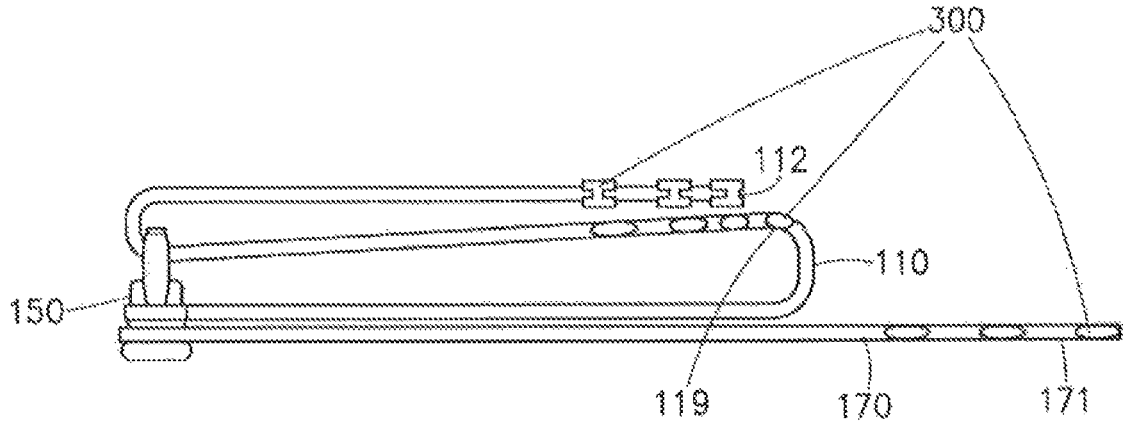
FIG. 8 is a schematic diagram of an alternative embodiment of a footwear cleats device with snap strap fasteners.

FIG. 8 shows an alternative embodiment where the shoe strap fastener end 112 attaches to the shoe strap 110 at the shoe strap intermediate point 119 with strap snap fasteners 300. Other types of fasteners may also be used according to the desired application, for example, but not limited to a bullet fastener, a buckle fastener, a hinged clasp, a slide lock fastener. In general, fasteners that are unlikely to be clogged with dirt, snow, ice, or mud may be preferred.

Once the footwear cleats device 100 is adjusted to the user's shoe, the fastener 130 may be easily accessible towards the top or side of the shoe/foot. This is important as it may allow use of long handled adaptive equipment, for example, a reacher or a dressing stick to release the cleat strap fastener end 171 from the cleat strap pin 132. This may make the footwear cleats device 100 accessible to users who have difficulty bending over, for example, users with decreased range of motion, balance, shortness of breath, etc.

The cleat strap 170 is configured to swivel around the swivel piece pin 152 and flip down and lay across the sole of the foot with the cleats 182 projecting outwards towards the ground as shown in the under-shoe (use) position in FIG. 4 and swivel and flip upwards with the cleats facing away from the top of the shoe, preventing damage to shoes as shown in the over-shoe (storage) position FIG. 3. In addition, this feature may provide visual feedback to users so they may see the current configuration of the footwear cleats device 100 and if the cleats 182 are engaged or disengaged for improved user safety.

Figure 9:
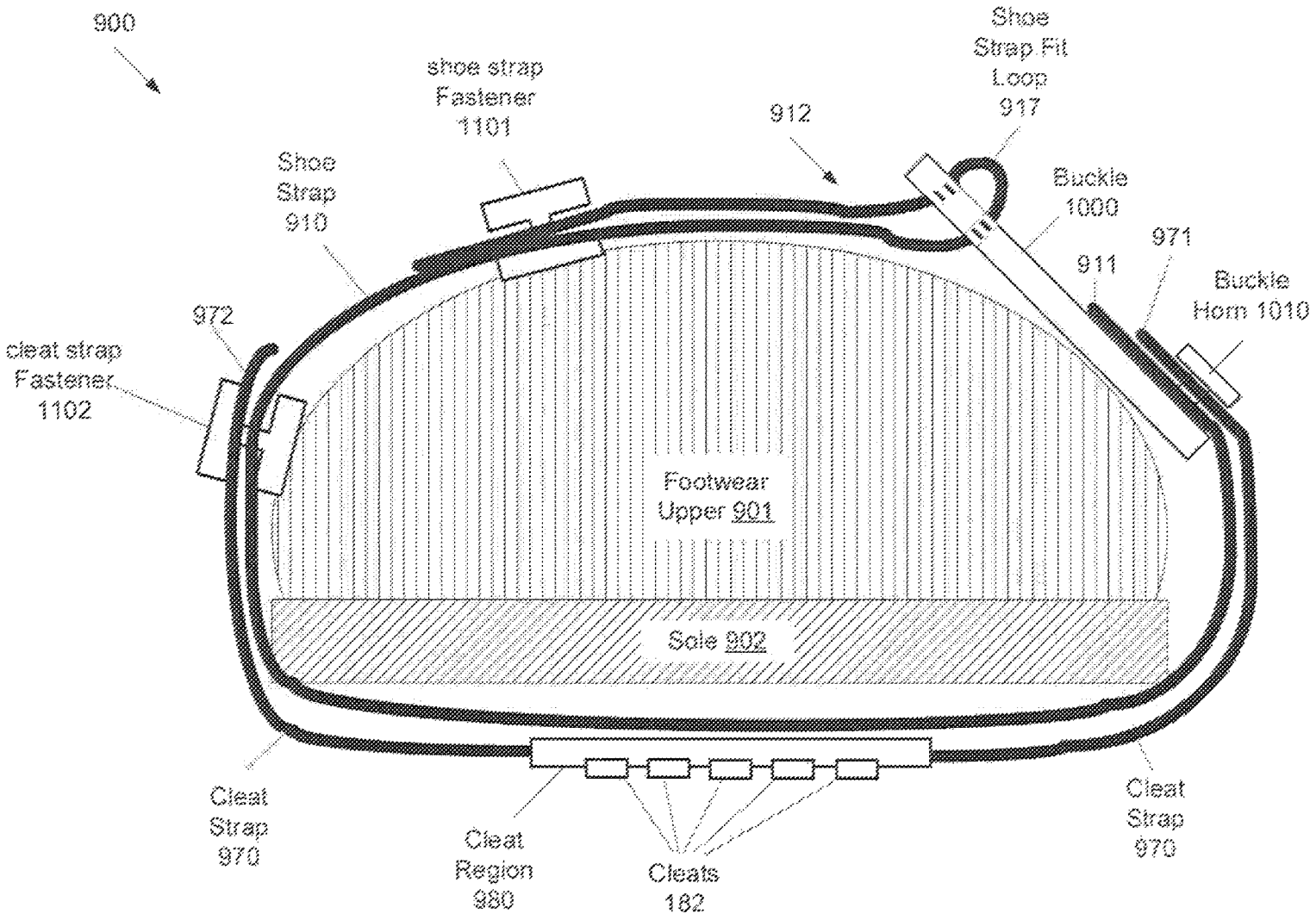
FIG. 9 is a schematic diagram showing a second exemplary embodiment of a footwear cleats device from a cross-section view in a first configuration.

FIG. 9 shows a second exemplary embodiment of a footwear cleats device 900 from a cross-section view. A flexible shoe strap 910 is configured to wrap around a footwear (shoe or boot) upper 901 and shoe sole 902, for example, around the ball portion of a foot of the wearer. A buckle 1000 is configured to secure the shoe strap 910 around the footwear. A shoe strap fastener 1101 and a cleat strap fastener 1102 attach to the shoe strap 910.

A cleat strap 970 includes a cleat region 980 that is configured to hold a plurality of cleats 182 at an intermediate portion of the cleat strap 970. A cleat strap first end 971 removably and/or rotatably attaches to the buckle 1000, and a cleat strap second end 972 removably and/or rotatably attaches to a cleat strap fastener 1102.

Figure 11:
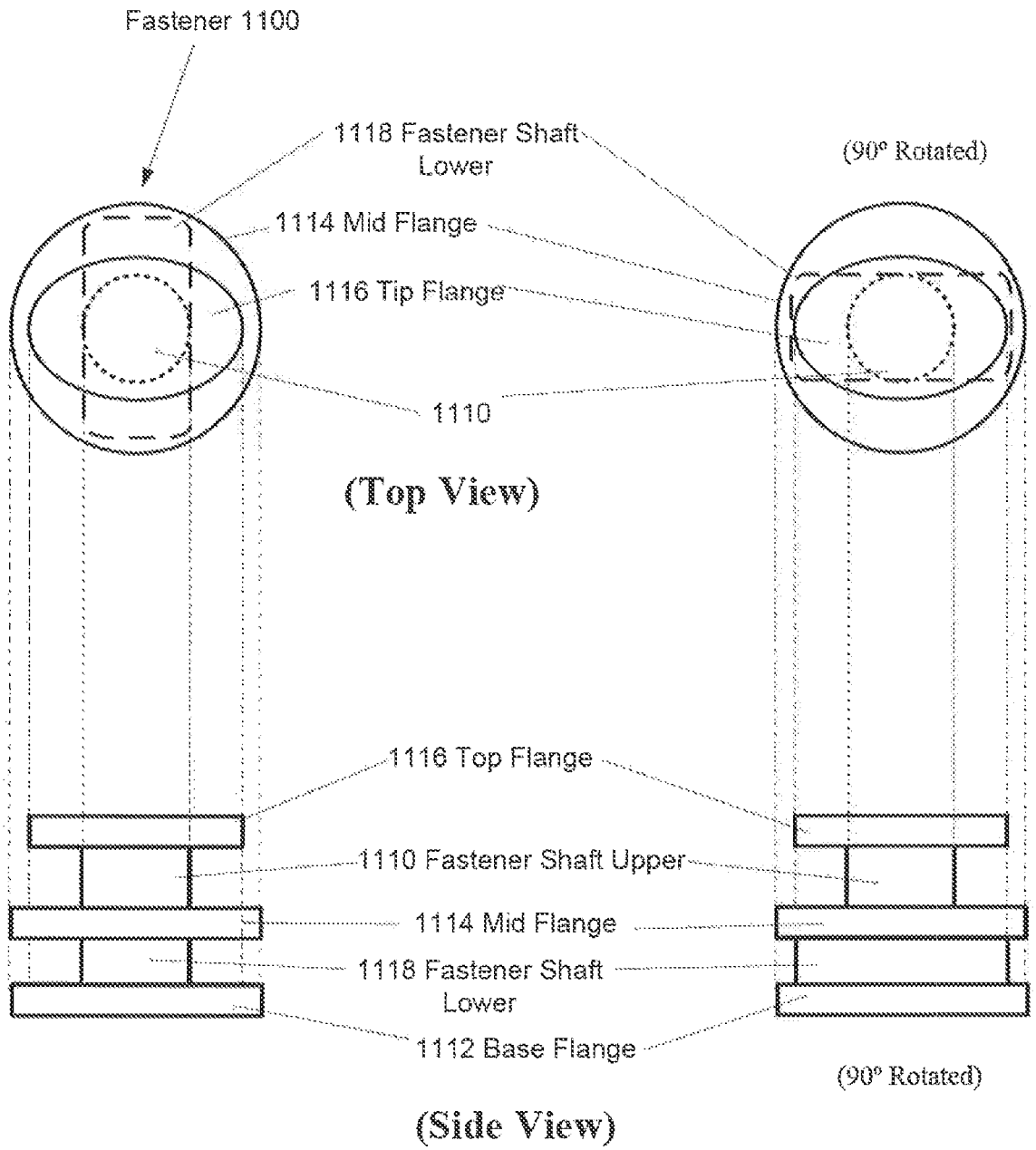
FIG. 11 is a schematic diagram providing four views of the footwear cleats device fasteners of FIG. 9
Figure 12A:
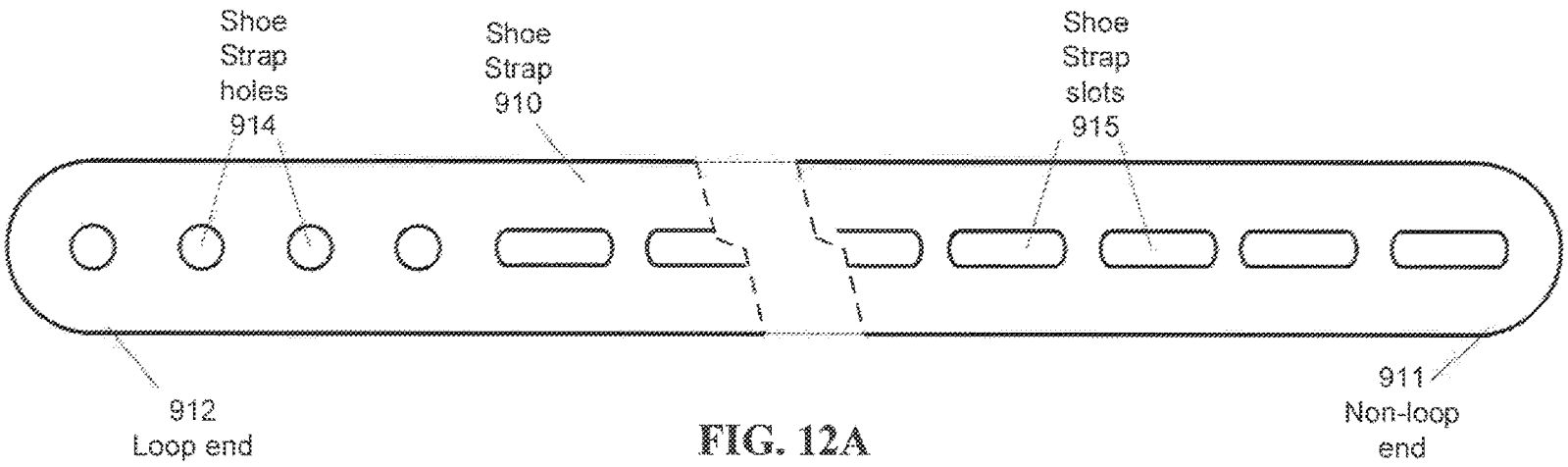
FIG. 12A is a schematic diagram showing a flattened top perspective of the flexible shoe strap of FIG. 9.

FIG. 12A shows a flattened top perspective of the flexible shoe strap 910. Under the exemplary second embodiment, the shoe strap 910 may be, for example, on the order of 14-18 inches long, between 0.6 and 1.5 inches wide, and on the order of 0.05-0.15 inches thick. These dimensions may vary according to the size of the footwear, among other considerations. The shoe strap 910 has a loop end 912, and a non-loop end 911. The shoe strap 910 has a plurality of perforations through a top side to a bottom side, including a plurality of shoe strap holes 914 having a substantially circular cross section shape at the loop end 912, and a plurality of elongated shoe strap slots 915 extending from the non-loop end 911 extending at least past a mid-point of a length of the shoe strap 910. The number of shoe strap holes 914 and shoe strap slots 915 is variable, depending upon the size of the footwear intended for use with the device 900. Each shoe strap hole 914 may have a substantially circular cross section shape, having a radius sized to fit around the fastener shaft upper 1110 and around the fastener shaft lower 1118 (FIG. 11). Each shoe strap slot 914 may have a substantially rectangular cross section shape, sized to fit around the fastener shaft lower 1118 (FIG. 11) and/or the buckle horn shaft 1018 (FIG. 10) without rotating.

Figure 12B:
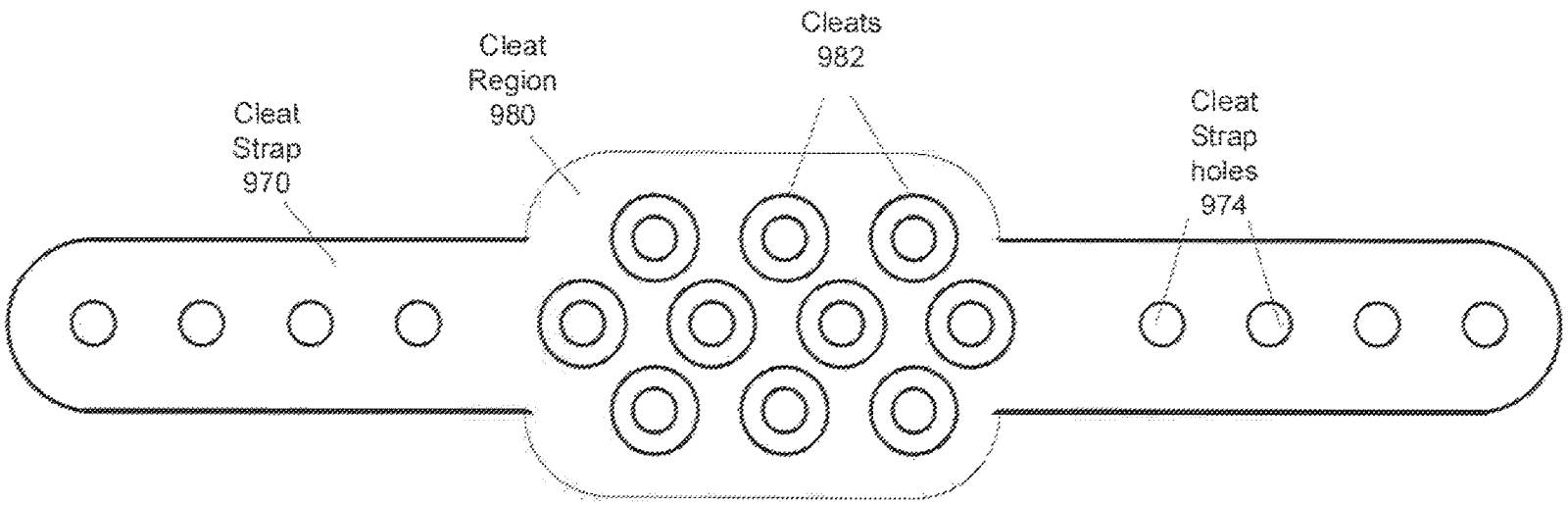
FIG. 12B is a schematic diagram showing a flattened top perspective of the flexible cleat strap of FIG. 9.

FIG. 12B shows a flattened top perspective of the flexible cleat strap 970. The cleat strap 970 has a first end and a second end opposite the first end. The cleat strap 970 has a cleat region 980 disposed at an intermediate portion between the first and second ends. The cleat region 980 is configured to accommodate a plurality of cleats 982. The cleats 982 of the second embodiment may be substantially similar to the previously described cleats 182 of the first embodiment. While FIG. 12B depicts the cleat region 980 located at a middle portion of the cleat strap 970, in alternative embodiments the cleat region 980 may be offset toward either the first or second end of the cleat strap 970.

The cleat strap 970 has a two perforated regions on opposite sides of the cleat region 980, each perforated region having plurality of cleat strap holes 974. The number of cleat strap holes 974 on either side of the cleat region 980 is variable, depending upon the size of the cleat region 980 and/or the footwear intended for use with the device 900. Each cleat strap hole 974 has a substantially circular cross section shape, having a radius sized to fit around the fastener shaft upper 1110 (FIG. 11) and/or the buckle horn 1010 (FIG. 10). The round cleat strap holes 974 facilitate the cleat strap 970 rotating around the buckle horn 1010 (FIG. 10) and/or the fastener shaft upper 1110 (FIG. 11).

For example, the cleat strap 970 may be, but is not limited to on the order of 6-10 inches in total length including the cleat region 980. The cleat region 980 may be on the order of 1.6-2.6 inches long. The cleat strap 970 may be on the order of 1 inch wide, while the cleat region 980 may be on the order of 1.75 inches wide. The cleat strap 970 is 1/16 in thick. The cleat region 980 may be approximately 0.25 inches thick, and may generally be thicker than the rest of the cleat strap 970, as the cleats 982 surround the cleat strap at the cleat region 980 with an approximate thickness of ¼ inch.

While FIG. 12B depicts the cleat region 980 being substantially wider than the cleat strap perforated regions, in alternative embodiments the cleat region 980 may be substantially the same width as the perforated regions.

Figure 10A:
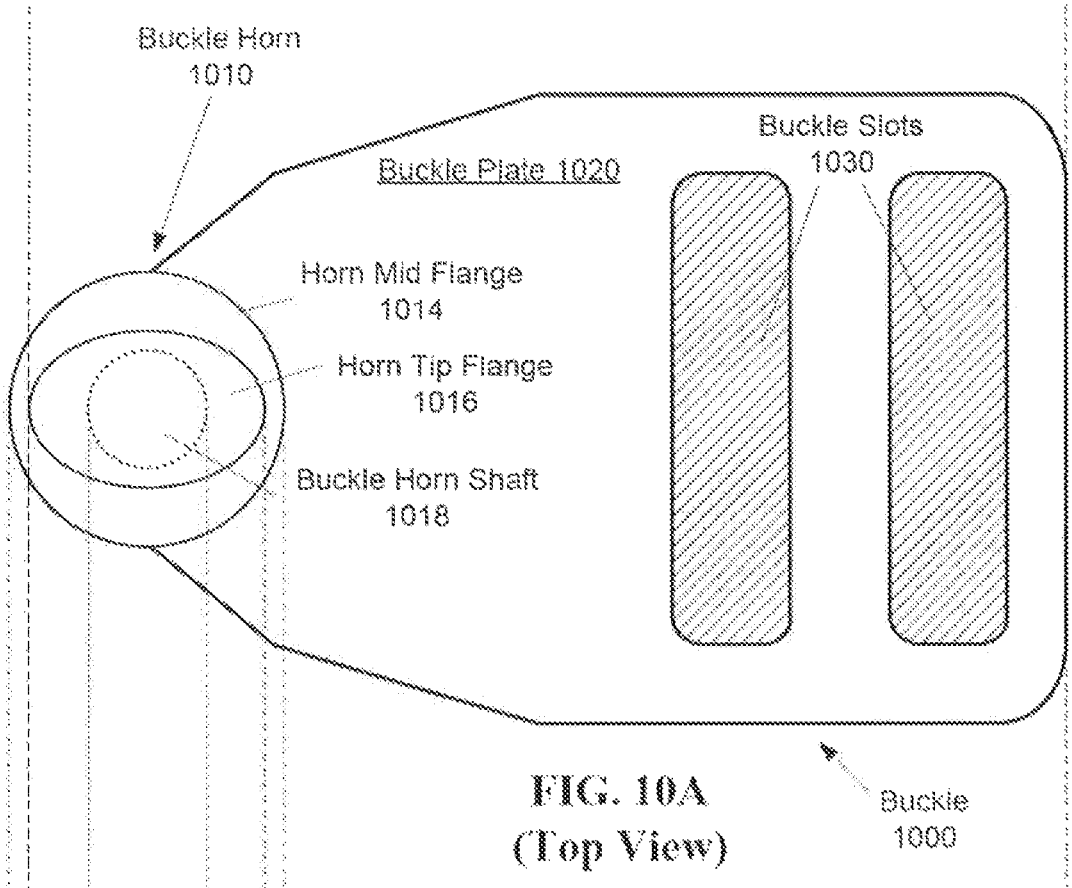
FIG. 10A is a schematic diagram detailing the footwear cleats device buckle of FIG. 9 from a top perspective view.
Figure 10B:
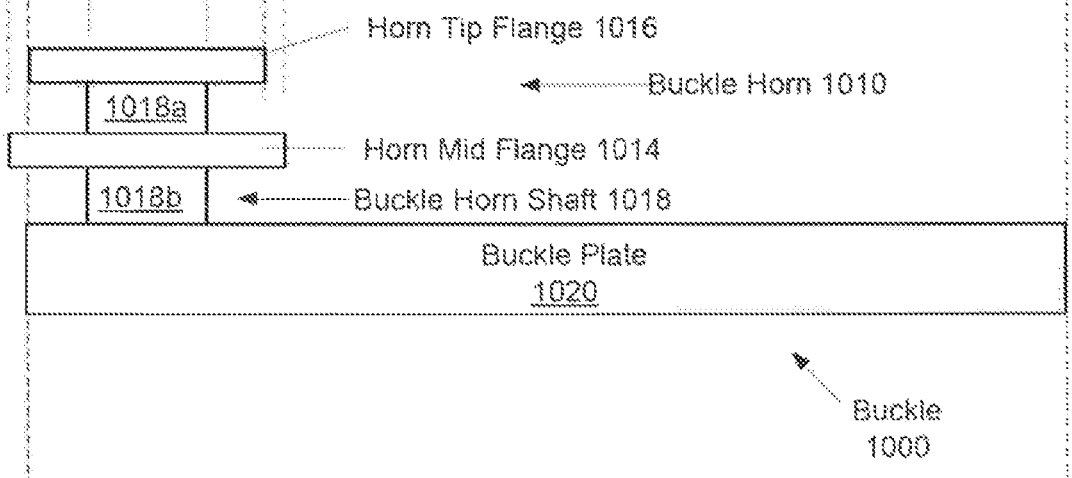
FIG. 10B is a schematic diagram detailing the buckle of FIG. 10A from a side perspective view.

FIGS. 10A and 10B respectively show top and side views of the buckle 1000. A base portion of the buckle 1000 may be a substantially flat buckle plate 1020. Under the second embodiment, the buckle plate profile from a top view (FIG. 10A) may be substantially rectangular at first end and tapered to a rounded top at a second end. In alternative embodiments, the buckle plate 1020 may be slightly curved to approximate the curve of a footwear upper portion 901 (FIG. 9). Likewise, the profile shape of the buckle plate 1020 may differ in alternative embodiments, for example, being more triangular, oval, or rectangular, among other profile shape. The buckle plate 1020 includes substantially rectangular buckle slots (apertures) 1030 that pass through the buckle plate 1020. The buckle slots 1030 accommodate the shoe strap 910 to be looped through the buckle plate 1020. The shoe strap loop end 912 is removably attached to the shoe strap fastener 1101. The shoe strap 910 may be loosened or tightened according to the strap hole 914 selected to attach to the shoe strap fastener 1101, thereby adjusting the position of the loop end 912 with respect to the buckle 1000.

For convenience, a first substantially planar surface of the buckle plate 1020 configured to face toward the footwear is referred to as the interior surface, and a second substantially planar surface of the buckle plate 1020 opposite the buckle plate interior surface is referred to as the buckle plate exterior surface.

A buckle horn 1010 is attached to the exterior of the buckle plate 1020. The buckle horn is disposed near the tip of the tapered end of the buckle plate 1020, and protrudes outwardly from the buckle plate 1020 exterior surface and extends in a direction substantially normal to the buckle plate exterior surface. The buckle horn 1010 includes a horn tip flange 1016 capping an end portion of the buckle horn shaft. The horn tip flange 1016 may have a profile shaped to retain the shoe strap 910 (FIG. 12A) and cleat strap 970 (FIG. 12B) that have been slipped over the horn tip flange 1016 to engage the buckle horn shaft 1018. For example, the horn tip flange 1016 may have a substantially oblong or elliptical profile, among other possible shapes. A horn mid flange 1014 having, for example, a substantially circular profile, is disposed around the buckle horn shaft 1018 at a mid portion of the buckle horn shaft 1018 between the buckle plate 1020 and the horn tip flange. The horn mid flange 1014 may help prevent the straps 910, 970 from sticking to each other. A buckle horn upper 1018*a* is disposed between the horn mid flange 1014 and the horn tip flange 1016, and a buckle horn lower 1018*b* is disposed between the horn mid flange 1014 and the buckle plate 1020.

The surface area of the horn mid flange 1014 may be significantly larger than the profile area of the horn tip flange 1016. The horn mid flange 1014 is arranged to secure the non-loop end 911 (FIG. 12A) of the shoe strap 910 (FIG. 12A) between the buckle plate 1020 and the horn mid flange 1014. For example, a shoe strap slot 915 (FIG. 12A) may be slipped over the horn mid flange 1014. The horn mid flange 1014 is preferably sized to prevent the cleat strap holes 974 (FIG. 12B) from being slipped over the horn mid flange 1014. The buckle horn shaft upper 1018*a* (FIG. 10A) disposed between the horn tip flange 1016 (FIG. 10B) and the horn mid flange 1014 (FIG. 10B) may have a circular cross section shape to allow the cleat strap 970 to rotate around the buckle horn shaft 1018, while still being secured by the horn tip flange 1016. The buckle horn shaft lower 1018*b* disposed between the horn mid flange 1014 and the buckle plate 1020 may have also have a substantially circular cross section, although in alternative embodiments (not shown) the buckle horn shaft lower 1018*b* may have a substantially rectangular cross section shape to prevent the shoe strap 910 from rotating around the buckle horn shaft lower 1018*b*. Note, the horn mid flange 1014 and/or the fastener mid flange 1114 may be omitted in alternative embodiments, and are not shown in FIG. 9.

The buckle horn 1010 may be integrally formed with the buckle plate 1020, or may be formed separately from the buckle plate 1020 and attached to the buckle plate 1020, for example using an adhesive, among other attachment means.

Under the second embodiment, exemplary dimensions for the buckle horn 1010 may be, but are not limited to the following. The buckle plate 1020 may have a length of 1% inch by width of 1¼ inch at the slotted end with a thickness on the order of ¼ inch. The buckle horn 1010 may have a ½ inch length and a diameter of ¼ inch at the upper portion 1018*a* and a diameter of ½ inch wide at 1018*b*, both on the order of ¼ inch thick. The horn tip flange 1016 is ⅜ inch long, ¼ inch wide at center and tapered at both ends, and about ⅛ inch thick. The horn mid flange 1014, may be % inch in circumference and between 1/16-⅛ inches thick. The buckle 1000 may be formed by various conventional means, for example, molding, 3D printing, among others. The fasteners 1100 and/or buckle 1000 may be formed of a rigid or semi-rigid material such as plastic or metal. If metal is used, it is preferably a rust resistant metal or otherwise treated to resist rust and/or corrosion. Alternatively, the portions of the buckle 1000, for example the buckle plate 1010, may be formed of a semi-rigid material (such as a stiff rubber) with sufficient flexibility that the buckle plate 1010 may conform (for example, under tension from the shoe strap 910 and/or the cleat strap 970) to the contours of the footwear upper 901.

The shoe strap fastener 1101 and a cleat strap fastener 1102 attach to the shoe strap 910. The shoe strap fastener 1101 is used to removably fasten the shoe strap loop end 912 to an interior portion of the shoe strap 910. The cleat strap fastener 1102 is used to removably fasten the cleat strap 970 to the shoe strap 910. Under the second embodiment, the shoe strap fastener 1101 and the cleat strap fastener 1102 may be substantially identical, for example, as shown by the fastener 1100 of FIG. 11. In alternative embodiments, the shoe strap fastener 1101 and the cleat strap fastener 1102 may be distinctly configured.

A fastener shaft lower portion 1118 is attached to a base flange 1112. The fastener 1100 includes a top flange 1116 at an end portion of a fastener shaft upper portion 1110. The top flange 1116 may have a profile shaped to retain the shoe strap 910 or cleat strap 970 that have been slipped over the top flange 1116 to engage the fastener upper shaft 1010. For example, the top flange 1116 may have a substantially oblong or elliptical profile, among other possible shapes. A fastener mid flange 1114 having, for example, a substantially circular profile shape, is disposed between the fastener shaft upper 1110 and the fastener shaft lower 1118 between the base flange 1112 and the top flange 1116. For the cleat strap fastener 1102, the fastener mid flange 1114 may help prevent the straps 910, 970 from sticking to each other. For the shoe strap fastener 1101, the fastener mid flange 1114 may help prevent looped portions of the shoe strap 910 from sticking to each other.

The profile area of the fastener mid flange 1114 may be significantly larger than the profile area of the fastener top flange 1116. The fastener mid flange 1114 is arranged to secure the shoe strap 970 between the fastener base flange 1112 and the fastener mid flange 1114. For example, a shoe strap slot 915 may be slipped over the fastener mid flange 1114. The fastener top flange 1116 is preferably sized to allow the cleat strap holes 974 or the shoe strap holes 914 to be removably slipped over the fastener top flange 1116. The fastener shaft upper 1110 may have a circular cross section shape to allow the cleat strap 970 to rotate around the fastener shaft upper 1110, while still being secured by the fastener top flange 1116. In contrast, the fastener shaft lower 1118 may have a substantially rectangular cross section shape to prevent the shoe strap 910 from rotating around the fastener shaft lower 1118.

The shoe strap 910 and cleat strap 970 are each preferably formed of a material that allows the shoe strap to flex in directions normal to its length, but to not stretch substantially along its length, for example, by less than 5%, and preferably less than 2%. The shoe strap 910, the cleat strap 970, and the cleat region 980 may be formed of the same material previously described for their counterparts 110, 170, 180 of the first embodiment, described previously, for example, hypalon material.

The shoe strap non-loop end 911 is configured to attach to the buckle horn 1010. The shoe strap loop end 912 is configured to be adjustably looped through the buckle slots 1030, and secured by a shoe strap fastener 1101.

Figure 13:
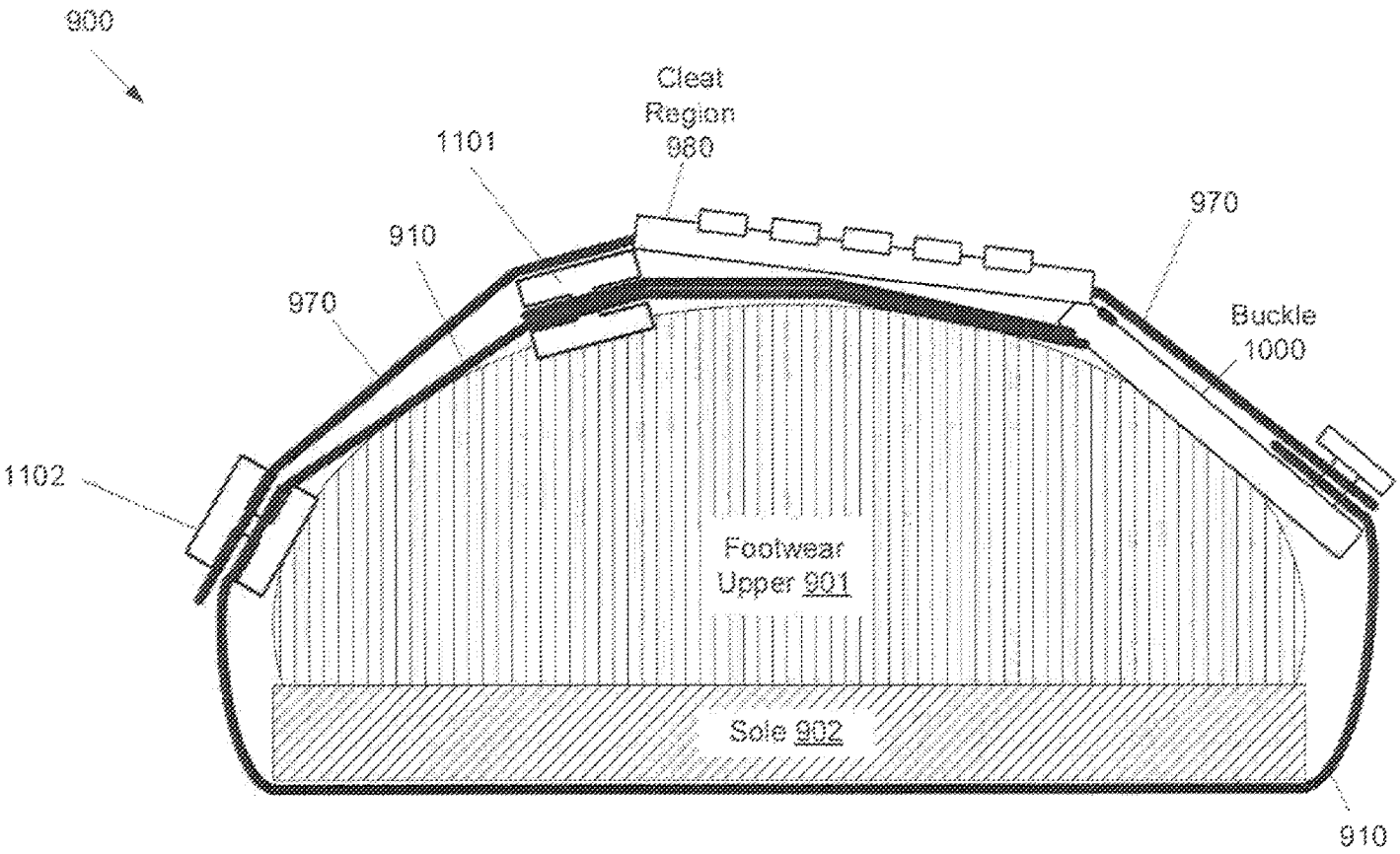
FIG. 13 is a schematic diagram showing the footwear cleats device of FIG. 9 in a second configuration.

Either end of the cleat strap 970 may rotatably attach to the buckle horn 1010. The opposite end of the cleat strap 970 removably attaches to the cleat strap fastener 1102 located on an opposite side of the shoe upper 901. For example, the buckle horn 1010 may be inserted through a cleat strap hole 974 such that the cleat strap 970 is secured to the buckle horn 1010, yet the cleat strap 970 may rotate freely around the buckle horn 1010. The cleat strap 970 attaches to the cleat strap fastener 1102 and the buckle horn 1010 in two configurations: A first configuration shown in FIG. 9 where the cleat region 980 is adjacent to the footwear sole 902 and the cleats 982 project outward from the sole 902; the second configuration where the cleat strap 970 is rotated around the buckle horn 1010 and spans across the footwear upper 901, so the cleat region 980 extends across a top of a footwear upper 901, rather than across the sole 902, as shown in FIG. 13.

The footwear cleats device 900 may be implemented in both child and adult sizes to accommodate various sizes for the cleat region 980. In alternative embodiments, the buckle 1000 and/or the strap fasteners 1101, 1102 may be implemented using other types of fasteners according to the desired application, for example, magnetic fasteners hook-and-loop fasteners, snaps, a bullet fastener, a hinged clasp, and a slide lock fastener, among others. In general, fasteners that are unlikely to be clogged with dirt, snow, ice, or mud may be preferred.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A fall prevention device for use with indoor and outdoor footwear, comprising:

a first strap comprising a first end, a second end opposite the first end, and an intermediate portion disposed between the first and second end, the first strap configured to wrap around an upper portion and sole of the footwear at a region of the footwear corresponding to the midfoot and/or forefoot of a wearer of the footwear;

a first fastener configured to removably secure a loop in the first strap between the first strap first end and the first strap intermediate portion;

a second fastener further comprising:

a strap loop retaining portion configured to slidably receive the looped first end of the first strap; and a post configured to protrude through an aperture at a second end of the first strap;

a second strap comprising a first end, a second end, and a cleat region comprising a plurality of cleats disposed between the first end and the second end, the first end configured to rotatably attach to the second fastener post; and a third fastener configured to attach to the first strap between the first strap second end and the first fastener, and to removably receive the second strap second end, wherein the device is configured to facilitate relocation of the second strap cleat region between a first position under the footwear sole and a second position over the footwear upper.

2. The device of claim 1, wherein the first strap is configured to attach to the footwear via a friction fit with adjustable tension according to an adjustable size of the looped first end of the first strap.

3. The device of claim 2, wherein the friction fit tension is adjusted by changing a size of the first strap loop.

4. The device of claim 1, wherein the second fastener further comprises:

a substantially planar base plate, wherein the post is disposed at a base plate first end, the post protruding from a base first surface, the strap loop retaining portion is disposed at a base plate second end substantially opposite the first end, the strap loop retaining portion further comprising two slot apertures passing through the base plate first surface and a base plate second planar surface opposite the base plate first surface, the strap loop retaining portion is configured to slidably receive the looped first end of the first strap passing through the two slot apertures, and the post is configured to protrude through a post receiving aperture at a second end of the first strap.

5. The device of claim 1, wherein the second fastener post further comprises an end cap configured to retain the first strap and/or the second strap upon the post.

6. The device of claim 5, further comprising a disc shaped flange portion of the second fastener post, the flange portion disposed between the base plate and the end cap, the flange portion having a center coincident with a center axis of the second fastener post.

7. The device of claim 6, wherein the flange portion is configured to separate the first strap and the second strap on the second fastener post.

8. The device of claim 7, wherein the post has a substantially circular cross section between the end cap and the flange, and the shaft has a substantially rectangular cross section between the flange and the base plate.

9. The device of claim 1, wherein the first fastener and/or the third fastener comprises:

a substantially disc shaped base flange;

a shaft extending from the base flange; and a top flange capping the shaft opposite the base flange.

10. The device of claim 9, wherein the first fastener and/or the third fastener further comprises a disc shaped mid flange disposed on the shaft between the base flange and the top flange.

11. The device of claim 10, wherein the shaft has a substantially circular cross section between the top flange and the mid flange, and the shaft has a substantially rectangular cross section between the mid flange and the base flange.

12. The device of claim 10, wherein the mid flange portion is configured to separate the first strap and the second strap on the shaft.

13. The device of claim 10, wherein the mid flange portion is configured to separate a first looped portion of the first strap and a second looped portion of the first strap on the shaft.

14. The device of claim 1, wherein the plurality of cleats are removably attached to the cleat region.

15. The device of claim 4, wherein the substantially planar base plate comprises a curve or contour to accommodate a complementary curve/contour of the footwear upper.

* * * * *